US009896834B1

(12) United States Patent
Hyams et al.

(10) Patent No.: US 9,896,834 B1
(45) Date of Patent: Feb. 20, 2018

(54) TREE HOUSE ELEVATED IN A SIMULATED TREE, AND METHOD OF MAKING

(71) Applicants: Jeanette Hyams, Springfield, MO (US); Michael Hyams, Springfield, MO (US)

(72) Inventors: Jeanette Hyams, Springfield, MO (US); Michael Hyams, Springfield, MO (US)

( * ) Notice: Subject to any disclaimer, the term of this patent is extended or adjusted under 35 U.S.C. 154(b) by 0 days.

(21) Appl. No.: 15/397,997

(22) Filed: Jan. 4, 2017

Related U.S. Application Data

(63) Continuation-in-part of application No. 15/054,274, filed on Feb. 26, 2016, now abandoned, which is a continuation-in-part of application No. 14/595,035, filed on Jan. 12, 2015, now abandoned.

(60) Provisional application No. 61/903,573, filed on Nov. 13, 2013.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04B 1/34*** | (2006.01) |
| ***E02D 27/10*** | (2006.01) |
| ***E02D 27/32*** | (2006.01) |
| ***E04B 1/24*** | (2006.01) |
| ***E04F 13/04*** | (2006.01) |
| *E04B 1/32* | (2006.01) |

(52) U.S. Cl.
CPC ..... *E04B 1/3404* (2013.01); *E02D 27/10* (2013.01); *E02D 27/32* (2013.01); *E04B 1/24* (2013.01); *E04F 13/047* (2013.01); *E04B 1/3211* (2013.01); *E04B 1/3412* (2013.01); *E04B 2001/3294* (2013.01)

(58) Field of Classification Search
CPC .... E04B 1/3211; E04B 1/3404; E04B 1/3412; E04B 2001/3294
USPC ..... 52/40, 81.2, DIG. 10, 73, 79.1, 79.4, 52/79.9, 741.1, 741.15, 745.04, 745.15, 52/745.17
See application file for complete search history.

(56) References Cited

U.S. PATENT DOCUMENTS

| | | | | |
|---|---|---|---|---|
| 2,166,002 A * | 7/1939 | Fritsch | B44F 9/02 156/223 |
| 3,452,493 A | 7/1969 | Mims | 52/73 |
| 3,455,069 A | 7/1969 | Keyes | 52/73 |
| 3,562,974 A | 2/1971 | Niemeyer | 52/73 |
| D220,947 S | 6/1971 | Bartoli | D13/1 |
| 3,600,865 A | 8/1971 | Vanich | 52/73 |

(Continued)

*Primary Examiner* — Chi Q Nguyen
(74) *Attorney, Agent, or Firm* — Jonathan A. Bay

(57) ABSTRACT

A tree house propped upon a simulated tree trunk has a platform, a cabin thereon, a main support column supported in a ground anchor, a plurality of diagonal struts, and a variety of simulate tree dressings for the column and struts. The cabin is built upon the platform and forms an inner living space that is served with potable water utilities, waste water utilities, and public-utility electric service. The main support column extends downward from the platform about a relative center of mass of the platform and cabin together, to ultimately sink into the ground anchor. The plurality of diagonal struts extended diagonally downward from the cabin radially spaced away from where the column extends downward from the platform, and join the column intermediate the platform and ground anchor. There furthermore are simulated tree trunk dressing covering the column, and, simulated tree branch dressing covering the struts.

20 Claims, 13 Drawing Sheets
(2 of 13 Drawing Sheet(s) Filed in Color)

(56) References Cited

U.S. PATENT DOCUMENTS

| | | | | |
|---|---|---|---|---|
| 3,633,325 | A | 1/1972 | Bartoli | 52/73 |
| D236,460 | S | 8/1975 | Fisher | D13/1 |
| 3,905,166 | A | 9/1975 | Kaiser | 52/65 |
| 4,056,902 | A | 11/1977 | Ziegler et al. | 52/73 |
| D260,180 | S | 8/1981 | Zusman | D25/17 |
| D269,042 | S | 5/1983 | Montalto | D25/23 |
| 4,567,709 | A | 2/1986 | Faw | 52/745.11 |
| 4,827,418 | A | 5/1989 | Gerstenfield | 701/120 |
| 5,267,420 | A | 12/1993 | Segman | 52/292 |
| 5,522,186 | A | 6/1996 | Jarman | 52/73 |
| 5,787,649 | A * | 8/1998 | Popowych | E04H 12/08 52/40 |
| D436,184 | S | 1/2001 | Reiter | D25/31 |
| 6,457,280 | B1 | 10/2002 | Park | 52/65 |
| 6,725,972 | B1 | 4/2004 | Krier | 182/187 |
| D607,119 | S | 12/2009 | Markar | D25/32 |
| D612,516 | S | 3/2010 | Stainton | D25/33 |
| 7,785,207 | B2 * | 8/2010 | Henry | A01G 9/022 472/117 |
| 7,992,350 | B2 | 8/2011 | Vriens | 52/40 |
| 8,042,652 | B2 | 10/2011 | Weir | 182/186 |
| 9,038,347 | B2 * | 5/2015 | Gundersen | E04B 1/30 52/636 |
| 9,309,662 | B2 * | 4/2016 | Vazquez | E04B 1/34352 |
| 2004/0261338 | A1 * | 12/2004 | De Cherance | E02D 27/06 52/292 |
| 2007/0028531 | A1 * | 2/2007 | Woodcock | E04B 1/3211 52/79.1 |
| 2007/0130875 | A1 * | 6/2007 | Detal | A63H 33/008 52/650.3 |
| 2015/0075112 | A1 * | 3/2015 | LeFebvre | A41G 1/007 52/741.1 |

* cited by examiner

TREE HOUSE ELEVATED IN A SIMULATED TREE, AND METHOD OF MAKING

CROSS-REFERENCE TO RELATED APPLICATION(S)

This application is a continuation-in-part of U.S. patent application Ser. No. 15/054,274, filed Feb. 26, 2016, which is a continuation-in-part of U.S. patent application Ser. No. 14/595,035, filed Jan. 12, 2015, which claims the benefit of U.S. Provisional Application No. 61/903,573, filed Nov. 13, 2013, the disclosures of which are incorporated herein by this reference thereto.

BACKGROUND OF THE INVENTION

The invention relates to static structures and, more particularly, to a fanciful tree house elevated on a simulated tree trunk.

A number of additional features and objects will be apparent in connection with the following discussion of the preferred embodiments and examples with reference to the drawings.

SUMMARY OF THE INVENTION

It is an object of the invention to build tree houses on simulated tree trunks such that, not only does the tree trunk seem real, but that also, the tree house seems like it could be a natural outgrowth of a real live tree.

It is popular nowadays to build tree house getaways which have as many of the amenities of comfort as a luxurious hotel suite. And these have been built in real live trees. However, real live trees are unsatisfactory because the live tree breaks and dies. Or else that, the real live tree is not always ideally located in the ideal place, or has an ideal form.

Some prior art solutions to this problem have included building "tree houses" on stilts like beach houses. The shortcoming here is that, the "tree house" indeed looks more like a beach house and than a tree house.

What is needed is a solution over the shortcomings of the prior art.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 3 is a perspective view showing the sinking and anchoring of the monopole support structure for the tree house into an excavated hole in the ground, and the attachment of it to a platform that is supported elevated off the ground by the monopole structure;

FIG. 4 is a plan view, partly in section, taken in the direction of arrows 4-4 in FIG. 2;

FIG. 5 is a side elevational view, partly in section, taken in the direction of arrows 5-5 in FIG. 4, and showing the beginning stages of the decoration of the structural (steel) monopole as well as the structural (steel) struts that together form the structural elevated support for the tree house, as tree trunk and branches, respectively:—with artistically constructed forms of steel reinforcing bars (rebar or rebar rods) comprising elongated wavy stringers of rebar rod extending lengthwise along what will become the simulate trunk or simulated branches, and, irregular rings of rebar rod that will provide approximate circumferential contour for the simulated trunk or branches;

FIG. 6 is a side elevational view that is partly in section and comparable to FIG. 5, except showing the rebar forms wrapped in a steel mesh screen and giving the rebar forms the outer contour of the simulated trunk and branches;

FIG. 7 is a side elevational view that is partly in section and comparable to FIG. 6, except showing the coating of the steel mesh screen with a layer of a coating material (including without limitation a polyurethane spray foam) which serve as the simulated bark of the simulated trunk and branches;

FIG. 8 is a side elevational view that is partly in section and comparable to FIG. 7, except showing that the coating material—while it is still wet—lends itself to several secondary processes, including without limitation being imprinted with a texture simulative of tree bark of a chosen species, being sculpted and/or dug into to simulate raised knots or recessed holes and so on; after which a further coating (eg., sealant, with color) might be applied;

FIG. 9 is a side elevational view that is partly in section and comparable to FIG. 8, except showing the simulated tree trunk with branches are further dressed with artificial—or, real—twiggy sprouts (with leaves as shown);

FIG. 10 is a side elevational view of a single twiggy sprout in isolation, wherein the leaves and branching form of this twiggy sprout might more nearly resemble the leaves and branching form of a different tree species than in FIG. 9 (eg., FIG. 9 is meant to be more simulative of a White Oak, whereas FIG. 10 is more simulative of an American Elm);

FIG. 11 is a perspective view comparable to FIG. 10 in part, except showing the twiggy sprout of FIG. 10 can be replaced during the seasons to reflect four seasons, namely, from top to bottom:—winter, spring, summer and fall;

DETAILED DESCRIPTION OF THE PREFERRED EMBODIMENTS

Figure 1:
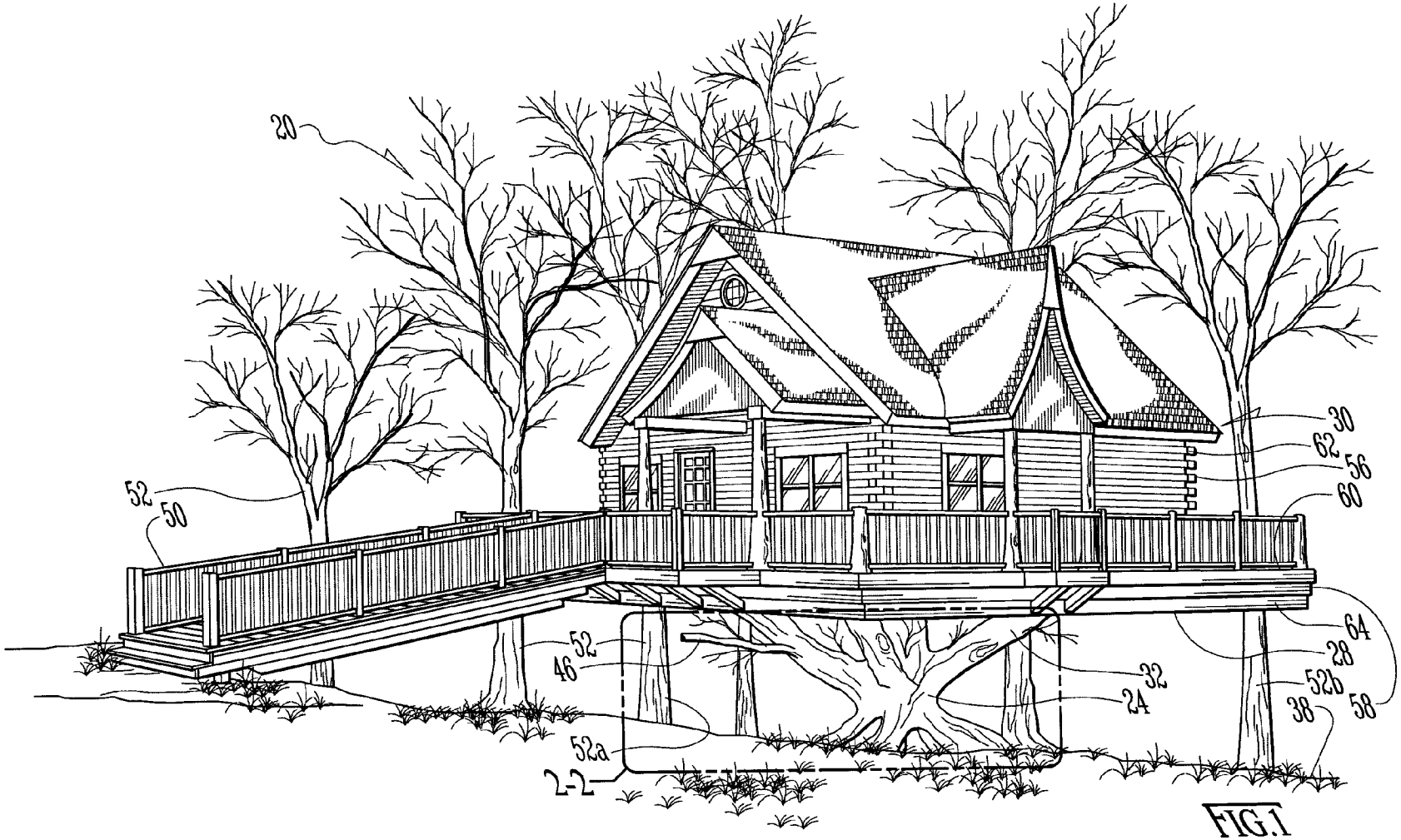
FIG. 1 is a perspective view of a tree house elevated in a simulated tree in accordance with the invention.

FIGS. 1-11 and 13-14 show an elevated tree house 20 propped on a monopole support structure 22 decorated as a simulated tree trunk 24 in accordance with the invention.

It is an aspect of the invention to incorporate and/or adapt the methods and materials of monopole platform construction used by the outdoor signage industry (eg., billboards along Interstate highways and the like).

The tree house 20 in accordance with the invention can be produced in the following manner and without limitation. Preferably the monopole 26 or column that will serve as the 'skeleton' for the simulated tree trunk 24 is a singular hollow structural (steel) monopole (eg., tube) in an about thirty-six to forty-two inch (~0.9 to 1.1 m) diameter. The monopole 26 is anchored/sunk in the ground 38 to stand erect. The monopole 26 is capped with an attached (steel) platform 28. The platform 28 carries the "house" 30, which can have any fanciful design including a rustic log cabin or the like, or else a more modern than traditional domicile in an elevated fashion.

The (steel) platform 28 is braced from underneath by a plurality of structural (steel) support braces 32 (eight to sixteen are preferred without limitation). These structural (steel) support braces 32 (or support arms) flare from base ends 34 attached to the monopole 26, to, upper ends 36 bracing the platform 28 spaced away from the monopole 26. In other words, the braces 32 flare out like stout limbs from a stout tree trunk. The number of braces 32 to use depends on several factors:—

(1) how high the monopole 26 tops out above the elevation of the ground 38, (2) the relative aspect ratio of height to diameter of the monopole 26, (3) the surface area of the elevated platform 28, (4) the design load to be carried by the platform 28, (5) the design wind load on the structure 20 as whole to withstand, and so on.

The support braces 32 and monopole 26 are then given a faux finish to create a simulated tree. The braces 32 and monopole 26 are covered in a network of rebar 40, some of which may project out as smaller limbs. The braces 32, monopole 26 and rebar 40 are wrapped in wire mesh screen 42. The wire mesh screen 42 is manipulated to resemble the form and furrowed surfaces of actual tree limbs and tree trunk. The wire mesh screen 42 is also suited for serving as an underlayer for sprayed foam 44 to adhere to. Hence the formed structure 22, 40, 42, etc. is covered in foam 44 to form solid simulated tree limbs 46 and a solid simulated tree trunk 24.

The formed structure 22, 40, 42, etc. may then be covered in an additional coating of a product called ZOOPDXY® which is then sculpted to resemble actual tree bark. It is believed that the composite material ZOOPDXY® is material that zoos use to create natural-looking animal habitat, eg., in the form of rocks and/or tree trunks or tree limbs and the like.

After that, the formed, covered and coated structure 22, 40, 42, 44 etc. is painted and from then ultimately takes on the characteristics and look of a tree in a forest. FIGS. 1-9 (excluding FIG. 3) show a simulated tree trunk 24 which more nearly resembles certain varieties of Beech trees or certain species of Oak trees (eg., White Oak or Live Oak) than other trees. Nevertheless, this is a non-limiting example of a design preference.

In the Northeastern U.S., it might be more desirable to simulate White Pine. In the Southeastern U.S., it might be more desirable to simulate Bald Cypress, and so on.

All utilities 48 are buried underground leading to the monopole 26, and run through the hollow center of the monopole 26. It is an aspect of the invention to hide the utilities 48 in order to add to the simulation of what a "real" tree would look like holding up a domicile 30 of some kind. It is a design preference to make the platform 28 and ultimately the house 30 accessible by ladders or stairs and the like (eg., like a ramp 50 too). In fact, a fairly sturdy ramp 50 and/or stairway is more preferred still. Such a sturdy ramp 50 and/or stairway helps tether the platform 28 and house 30 from oscillating in the wind about the vertical axis of the monopole 26. In other words, the sturdy ramp 50 and/or stairway helps spare occupants from becoming seasick.

To give FIG. 1 renewed study, it shows a house 30 elevated in a simulated tree 24, 46, etc. in accordance with the invention, as propped up on a simulated tree trunk 24 in accordance with the invention. The simulation is not intended to really fool anyone. Instead, the simulation is more intentionally meant to promote a romantic, storybook atmosphere to the tree house 20, so that users will hopefully have a romantic, storybook ending to their stay there.

The site location for this tree house 20 is chosen on a wooded slope 38. The pre-existing trees 52 are mature but way too weak to serve as the actual monopole 26 for this house 20. Locating the tree house 20 on a slope 38 is preferred for the following two reasons. The ramp 50 can be run from the high ground to the platform 28 at a shallower angle. Therefore, the high ground is the front of the house 30, where the parking is. The back of the platform 28/house 30 is cantilevered over the dropping ground. In other words, the tree house 20 is located so that the back of the house 30 overlooks a vista above dropping ground.

Figure 3:
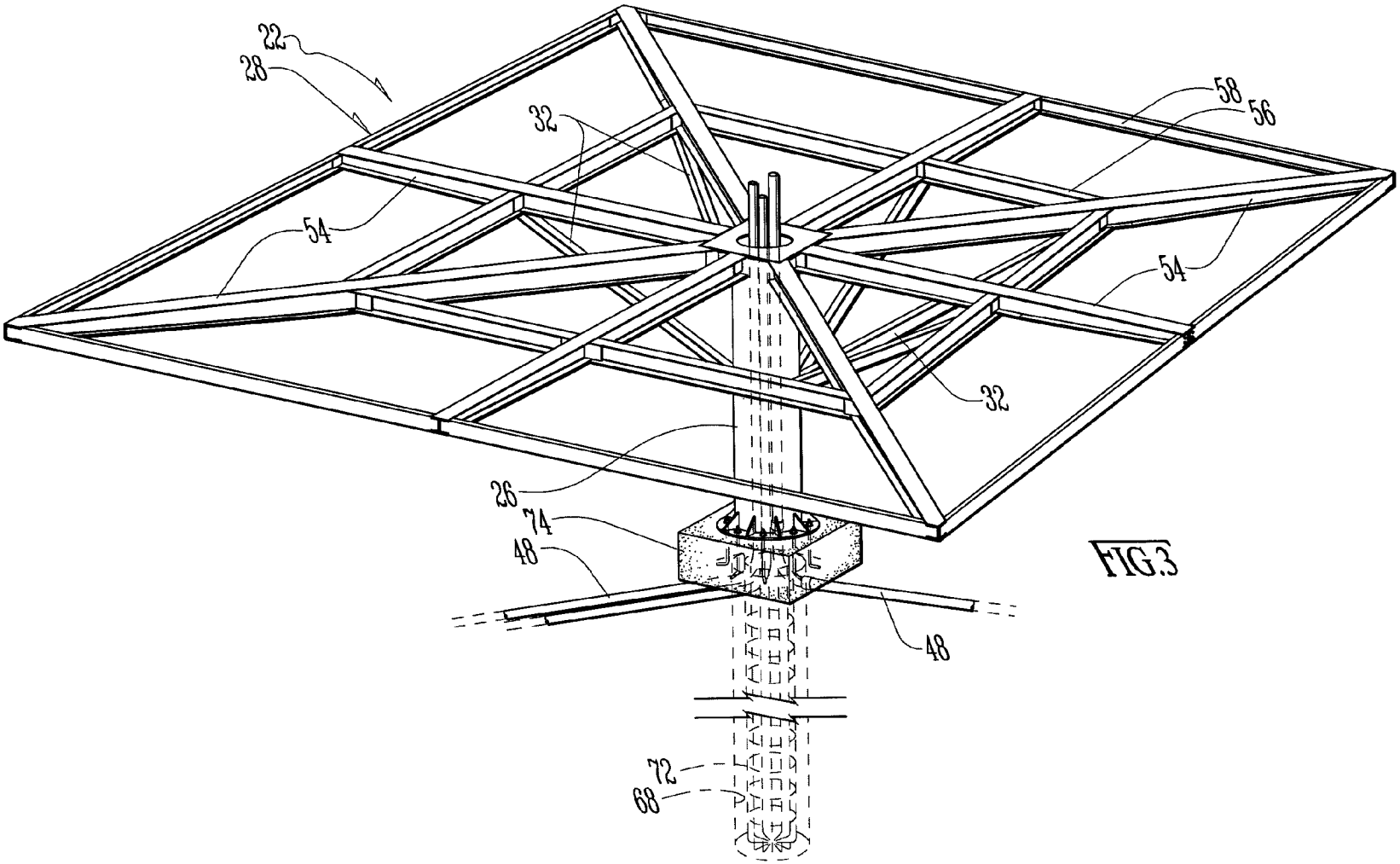
FIGS. 3 through 11 are a series of views showing various stages of construction of the tree house elevated in a simulated tree in accordance with the invention, one preferred embodiment of which is shown by FIG. 1, wherein:—

To look briefly ahead to FIG. 3, it shows that main structural (steel) support 22 for the tree house 20 optionally comprises the following, namely:—

(1) the structural (steel) monopole 26;

(2) structural (steel) braces 32 (eight shown); and (3) structural (steel) platform 28 frame members (eg., eight spokes 54, an inner quadrilateral 56, and, an outer quadrilateral 58 are shown).

The inner quadrilateral 56 corresponds to the outer walls 62 of the house 30. The outer quadrilateral 58 corresponds to the outer edges 64 of the surrounding platform 28 and its deck 60 surface.

To return back to FIG. 1, if a pre-existing tree trunk 52 rises up within what will be the inner quadrilateral 56, that tree 52*a* will have to be lopped off. If a pre-existing tree trunk 52 rises up within what will become the outer quadrilateral 58/surrounding deck 60, that tree 52*b* might be saved. The deck 60 might be formed with an opening to allow the tree 52*b* to continue to thrive. FIG. 1 shows two choices with trees 52*a* and 52*b* that pre-existed within the outer boundary 64 of the deck 60 and/or house 30 (for an example where at least one of the house 30's outer walls 62 forms the outer boundary 64 of the deck 60, see FIG. 12). The second kind of tree trunk 52*a* has been accommodated by an opening in the deck 60 (see also FIG. 4). The proprietors of the property will presumably strive to keep this tree 52*b* healthy. The first kind of tree trunk 52*a* was deemed too problematical or else unlikely to keep alive by construction of the tree house 20. Nevertheless, this tree's trunk 52*a* was chosen to be sufficiently ornamental to preserve. Hence, tree's trunk 52*a* has been lopped off at an elevation which is just sub-elevation for the platform 28. For observers from the front end of the tree house 20, tree trunk 52*a* will seem to be a natural growth into the platform 28.

Figure 2:
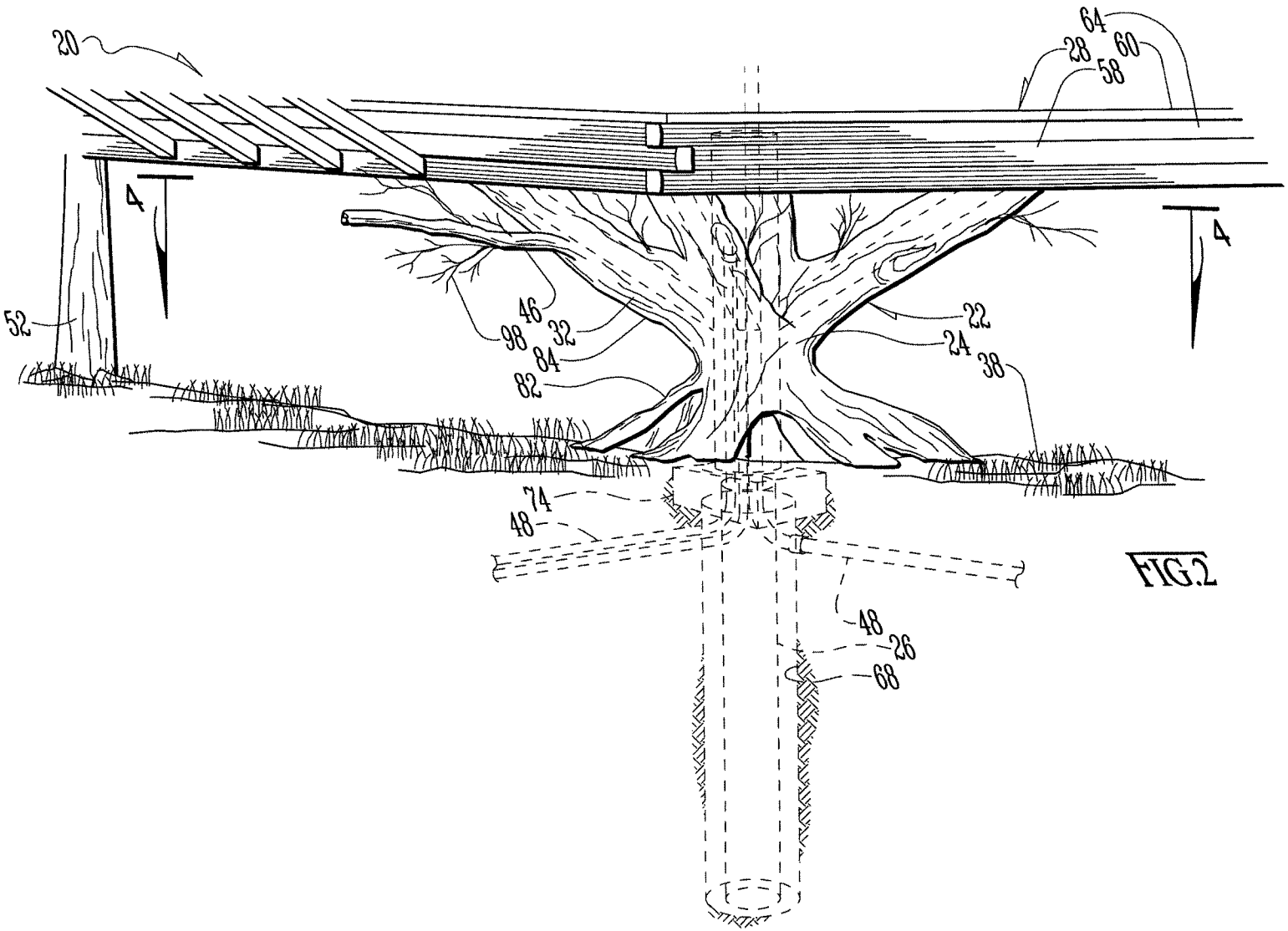
FIG. 2 is an enlarged scale perspective view of detail 2-2 in FIG. 1.

FIGS. 2 and 3 show the sub-ground engineering which supports the house 30 on the structural (steel) monopole 36. A deep hole 68 is 'excavated' (including either being drilled or dug). A structural steel pipe, or else a structural-steel rebar-rod cage 72 (among other options), can be lowered into the hole 68. A concrete box 'footing' 74 is poured around a rebar rod form referred to as a 'squirrel cage,' which is situated around the structural monopole 26 at below ground level, or just barely above. Utilities and services 48 are run underground into and up through the 'squirrel cage' footing 74, and from there up through the structural monopole 26, namely, and without limitation:—

(1) water;

(2) sewer;

(3) electric;

(4) cable/internet, and so on.

When construction is done (eg., see FIG. 1), the ground 38 beneath the tree house 20 is intended to be landscaped and cleaned up so that users find it appealing to walk underneath the tree house 20, and not just only limit their time on the deck 60 and inside the house 30.

Figure 4:
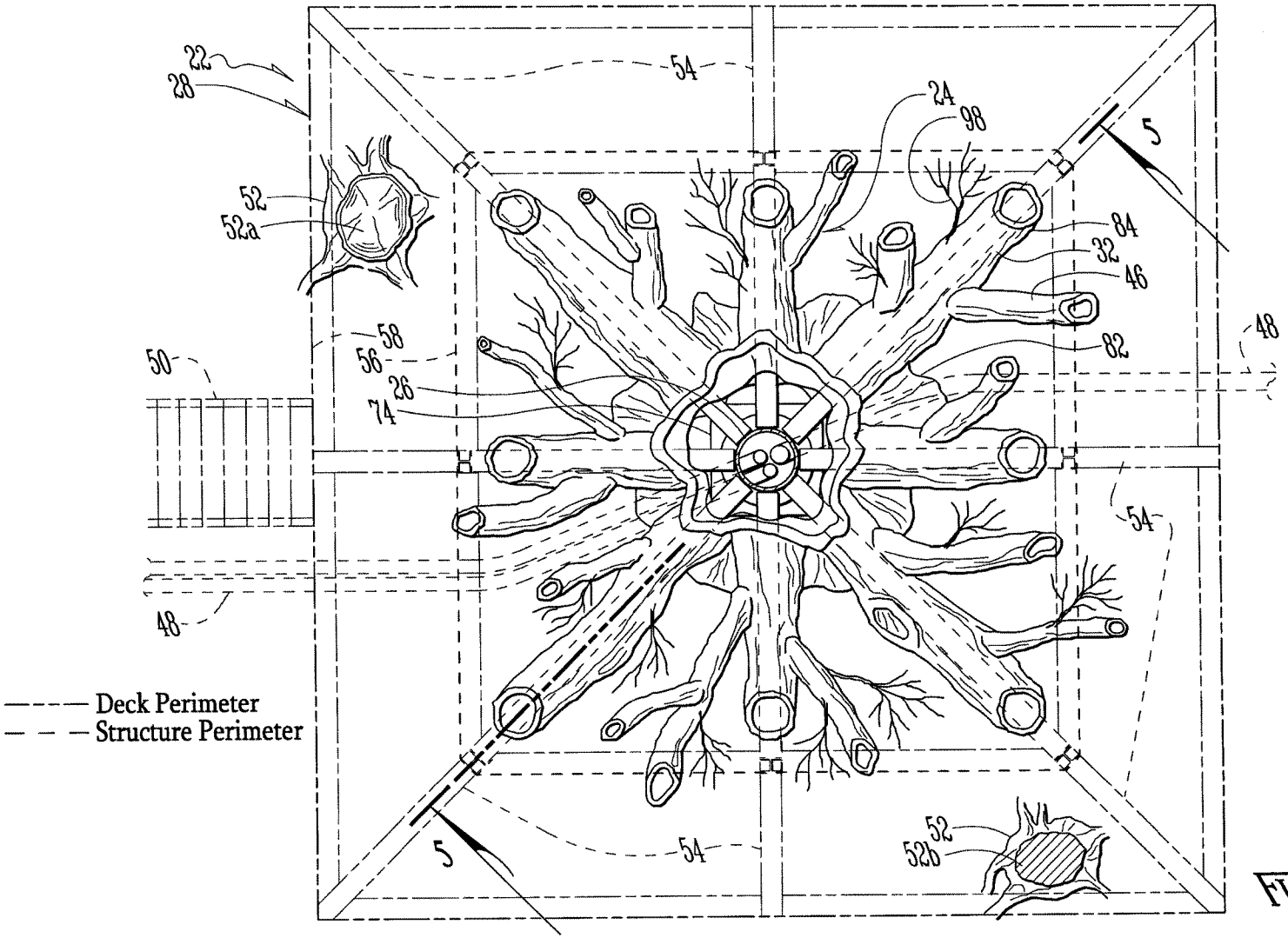

As previously mentioned, FIG. 4 shows one example of a tree 52*b* that was saved and accommodated to continue growing with an opening through the deck 60, and another example of a tree 52*a* which could not be saved but whose stump serves as further decoration.

Figure 5:
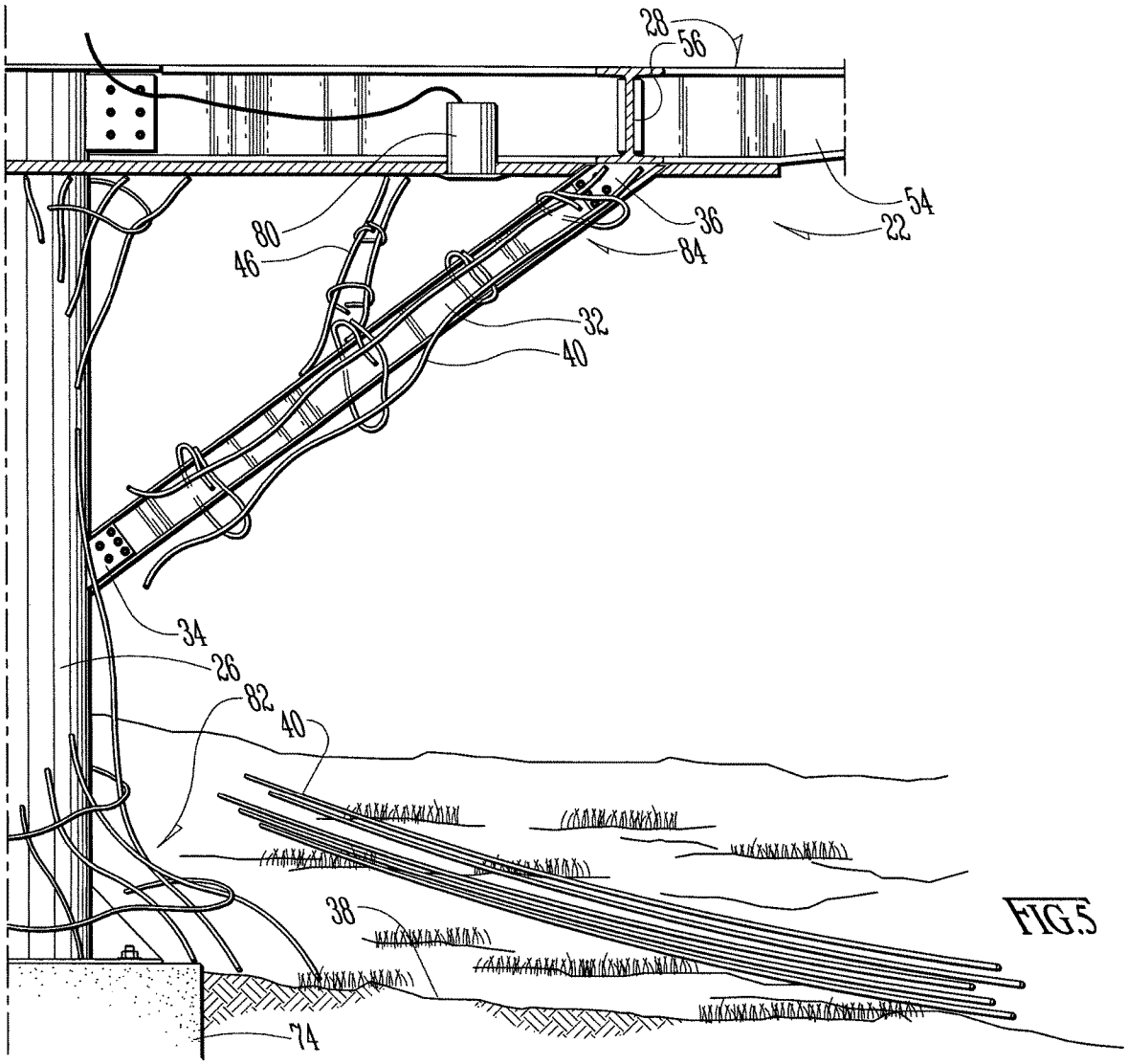

FIG. 5 shows the beginning stages of the decoration of the structural (steel) monopole 26 as well as the structural (steel) struts 32 that together form the structural elevated support for the house 30, as simulated tree trunk 24 and branches 46, respectively.

It is an aspect of the invention to utilize artisans to create forms 40 and 42 (or, form works) out of structural materials 40 and 42 in order to decorate and disguise the symmetric structural support 22 of the tree house 20 as simulating trunk 24, branches 46 and other tree parts and so on.

It is furthermore believed that, if a strut 32 were left bare for a small portion thereof, the romantic and/or storybook decoration which is ultimately sought is still intact. That is, a bare portion of a strut 32 otherwise covered in simulated tree branch decoration 46 appears as if vegetative growth swallowed the structural (steel) strut 32.

The preferred structural material to dress the monopole 26 and struts 32 begins with rebar rod 40. FIG. 5 shows artistically constructed forms of steel reinforcing bars 40 (rebar or rebar rods) comprising elongated wavy stringers of rebar rod 40 extending lengthwise along what will become the simulated trunk 24 or simulated branches 46, and, irregular rings of rebar rod 40 that will provide approximate circumferential contour for the simulated trunk 24 or branches 46.

Notice also that FIG. 5 shows can lights 80 underneath the deck 60. It is an aspect of the invention that, when construction is done (eg., see FIG. 1), the ground 38 beneath the tree house 20 is intended to be landscaped and cleaned up so that users find it appealing to walk underneath the tree house 20, and not just only limit their time on the deck 60 and inside the house 30.

Figure 6:
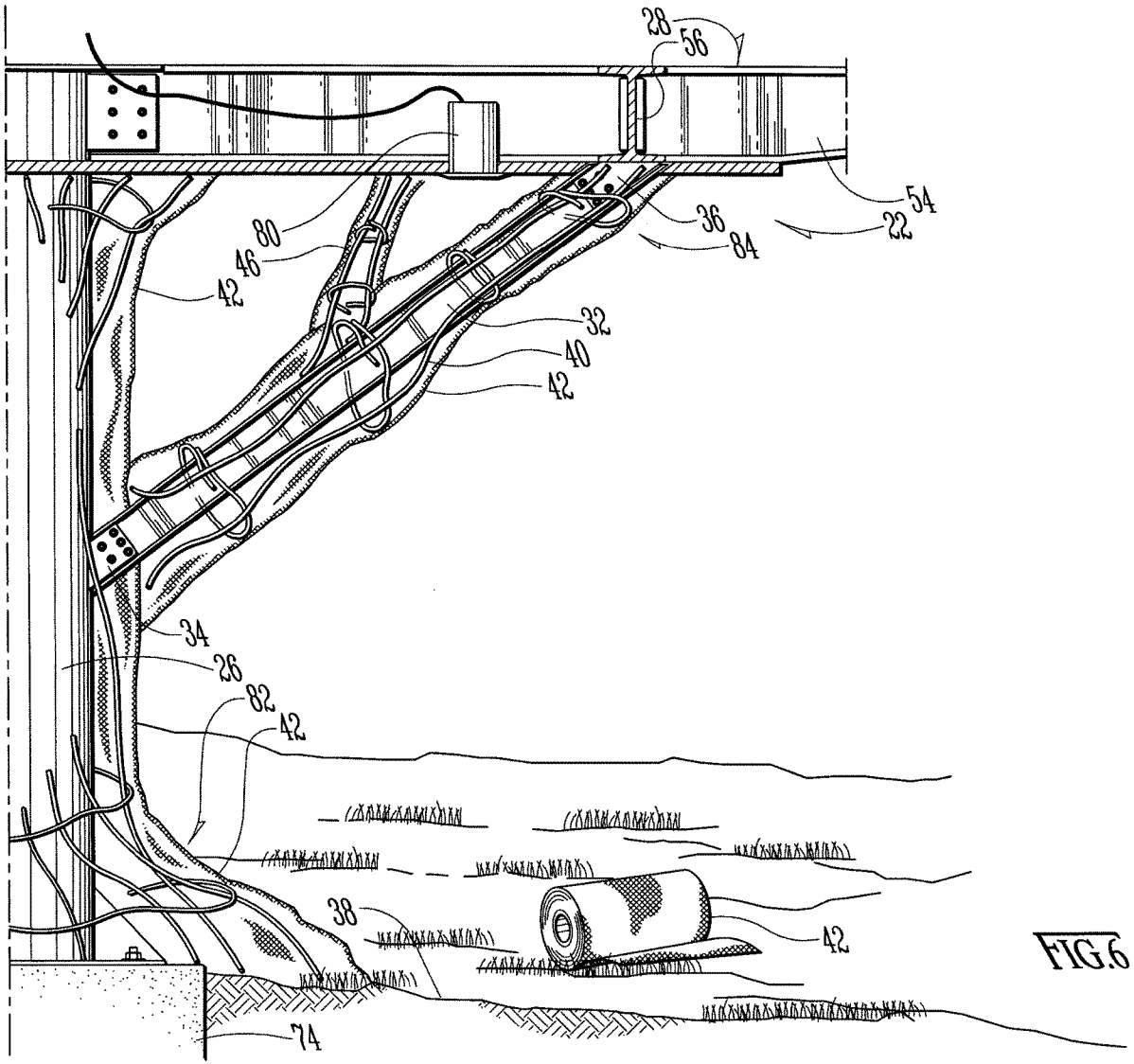

FIG. 6 shows the structural (steel) monopole 26 as well as the rebar forms 40 wrapped in a steel mesh screen 42 and giving the structural (steel) monopole 26 as well as the rebar forms 40 the outer contour of the simulated trunk 24 and branches 46, respectively. It is a design preference to give the simulated trunk 24 both a root flare 82 (a conic flare) and a crown flare 84 (an upside down conic flare).

Figure 7:
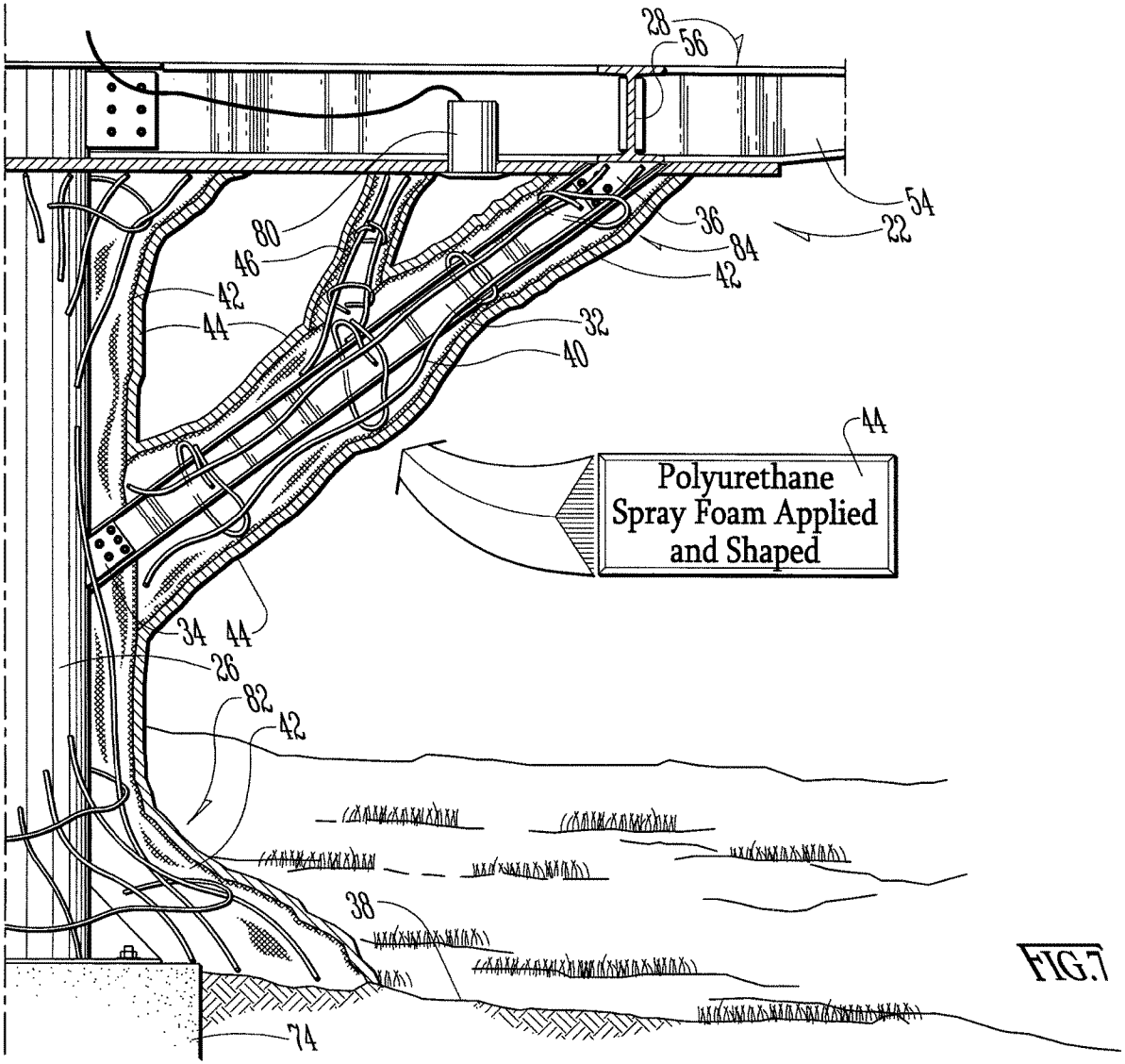

FIG. 7 shows or represents that the screen material 42 will be covered in a coating material 44. Preferably this coating material 44 has some thickness or volume. Such a suitable coating material 44 includes without limitation a polyurethane spray foam. This coating material 44 affords the possibility of further hand work to contour or sculpt. This coating material 44 will serve in part to function as simulated bark 86 of the simulated trunk 24 and branches 46.

Figure 8:
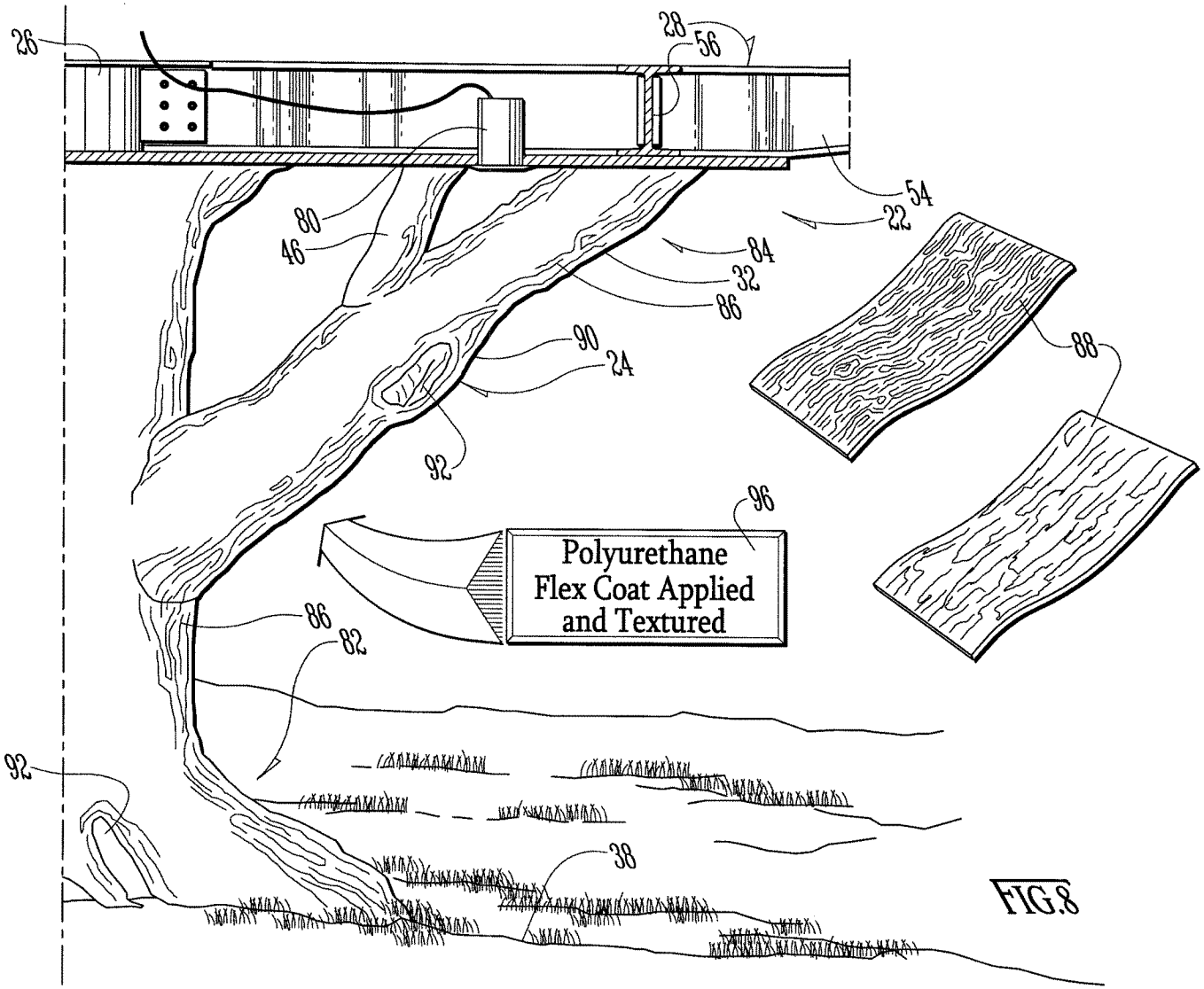

FIG. 8 shows or represents several things or events, some happening at different times (albeit, most events happening soon after the coating material 44 is applied as represented in FIG. 7).

For one, while coating material 96 is still wet (ie., not hardened, or at least still plastic/malleable), the surface of the coating material 96 lends itself to several secondary processes. These including without limitation that the surface of the still not-dry coating material 96 can be imprinted with a texture simulative of the tree bark 86 of a chosen species. This imprinting can be accomplished with silicone rubber mats 88 or the like, which are recessed in reverse image of the tree bark 86 of a chosen tree species. The upper mat 88 in FIG. 8 might more nearly resemble White Oak bark. The lower mat 88 in FIG. 8 might more nearly resemble Hickory bark.

Moreover, during this time, the coating material 88 can be sculpted and/or dug into to simulate raised knots 90 or recessed holes 92 and so on. To build knots 90, the coating material can be applied once, a knot 90 can be somewhat formed, more coating material 90 can be applied, and so on, such that the knot 90 is formed in a series of built-up layers. As for holes 92, it is desirable to provide illumination, such as a set of eyes (not shown), at the back of the holes 92. That way, the simulation is created that a creature is inhabiting the hole 92, and is staring back out.

After coating material 96 (eg., polymeric foam spray) is dry, a further coating might be applied. This might be a sealant, with color.

Figures 9, 10:
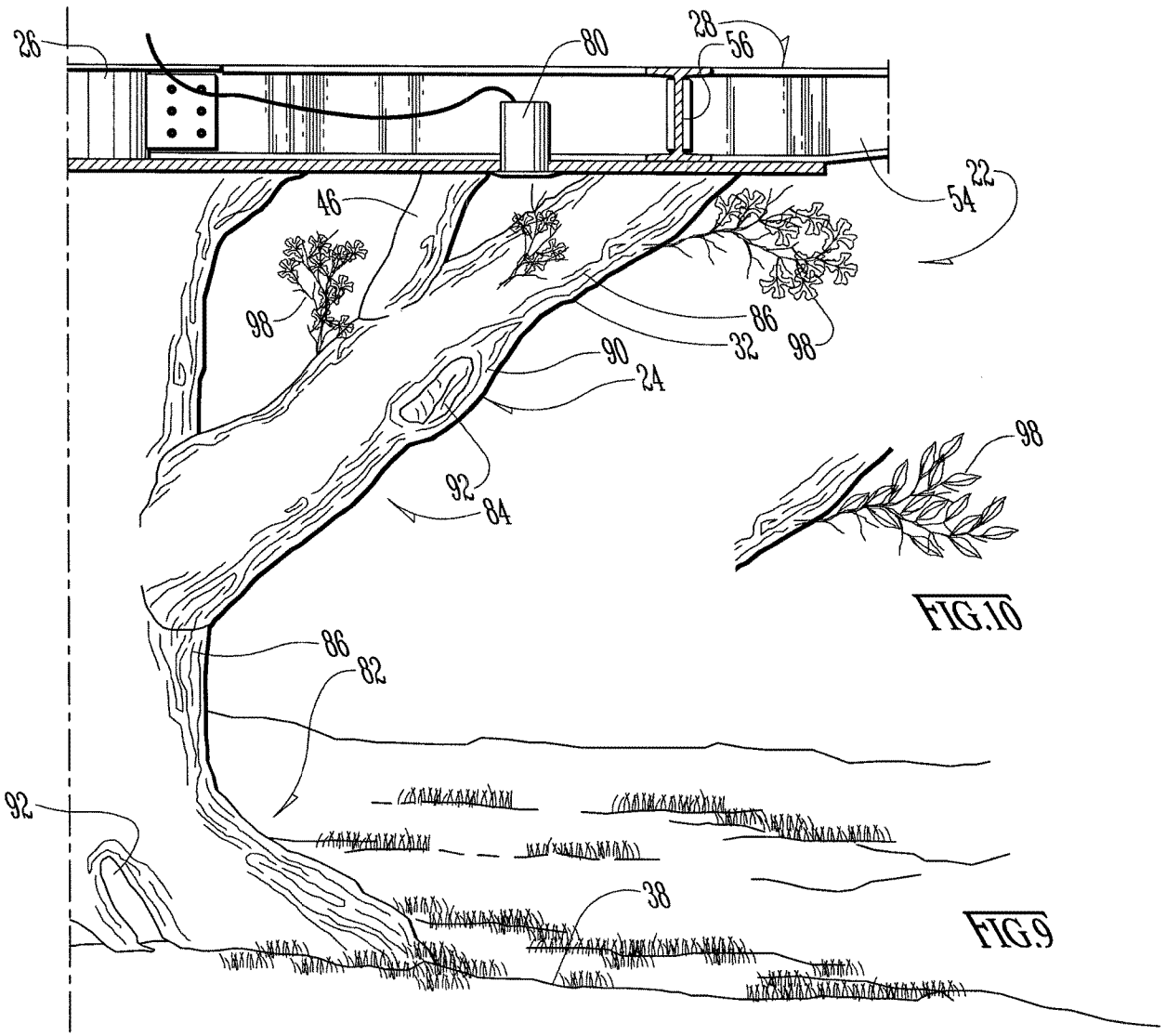

FIG. 9 shows that the simulated tree trunk 24 with simulated branches 46 can be further dressed with artificial—or, real—twiggy sprouts 98. FIG. 9 shows that the twiggy sprouts 98 have leaves, as shown, rather then being bare, as shown in part in FIG. 11.

FIG. 10 shows a single twiggy sprout 98 in isolation, to contrast with its counterpart in FIG. 9. That is, the leaves and branching form of this twiggy sprout 98 in FIG. 10 might more nearly resemble the leaves and branching form of a different tree species than in FIG. 9. (For example, FIG. 9 is meant to be more simulative of a White Oak, whereas FIG. 10 is more simulative of an American Elm).

It indeed is an aspect of the invention to garland the tree house 20 elevated on the simulated tree trunk 24 in accordance with the invention with live cut plant sprouts 98. Just like a highly rated resort might have fresh live cut flowers for the rooms of new guests, a guest-oriented proprietor of a tree house 20 elevated on the simulated tree trunk 24 might seasonally dress it with fresh live cut plant sprouts 98 now and then:—presumably according to season.

Figure 11:
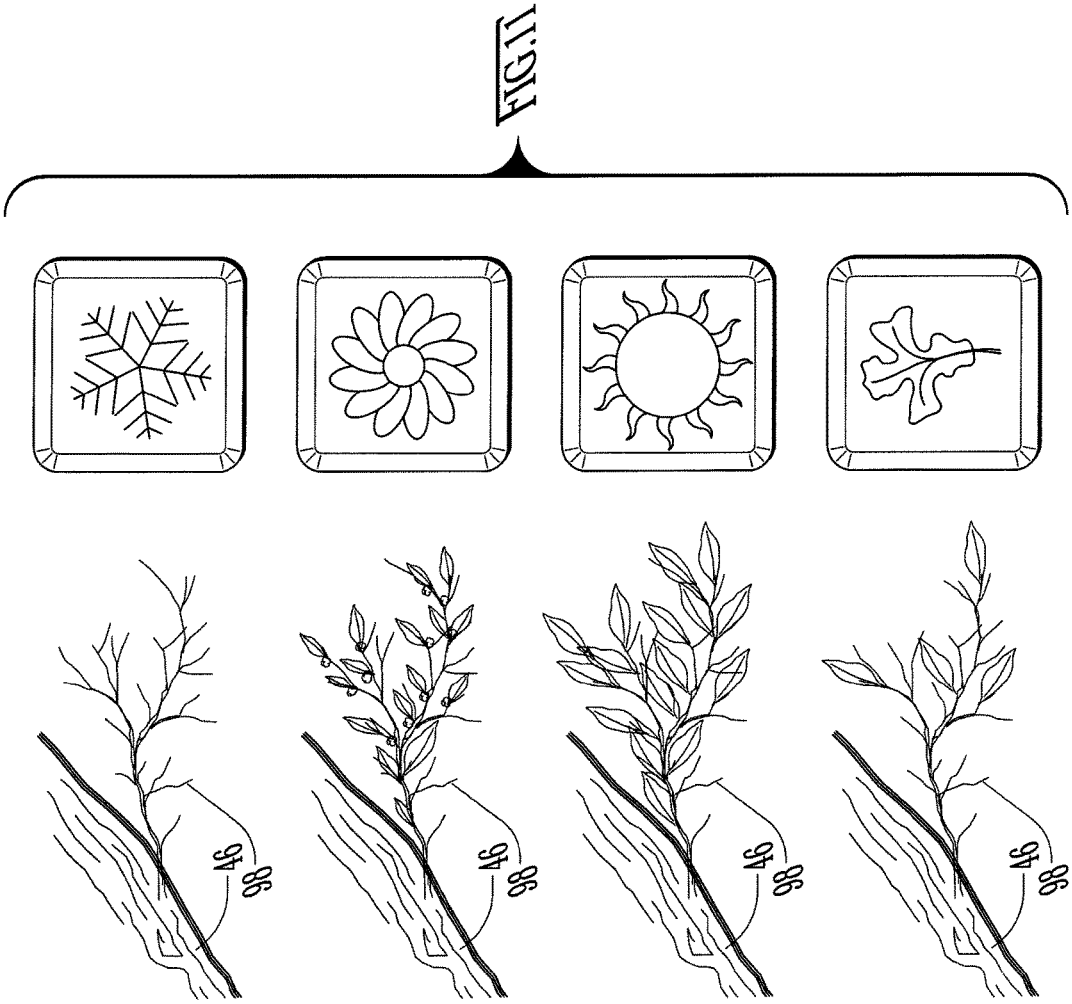

FIG. 11 is a perspective view comparable to FIG. 10 in part, except showing the twiggy sprout 98 of FIG. 10 can be replaced during the seasons to reflect four seasons, namely, from top to bottom:—winter, spring, summer and fall.

In the winter slide frame of FIG. 11, the twiggy sprout 98 is bare of leaves, as are the live Hickory trees in the surrounding woods.

In the spring slide frame of FIG. 11, the twiggy sprout 98 has newly emerging leaves, as well as newly emerging nut-fruit, as the live Hickory trees in that climate are doing as well.

In the summer slide frame of FIG. 11, the twiggy sprout 98 has full leaf growth as do the live Hickory trees in the surrounding woods (the nuts may or may not be included).

In the fall slide frame of FIG. 11, the twiggy sprout 98 has lost leaves and those which have hung on are presumably showing fall color, in accordance with what the live Hickory trees in that climate are doing as well.

Figure 12:
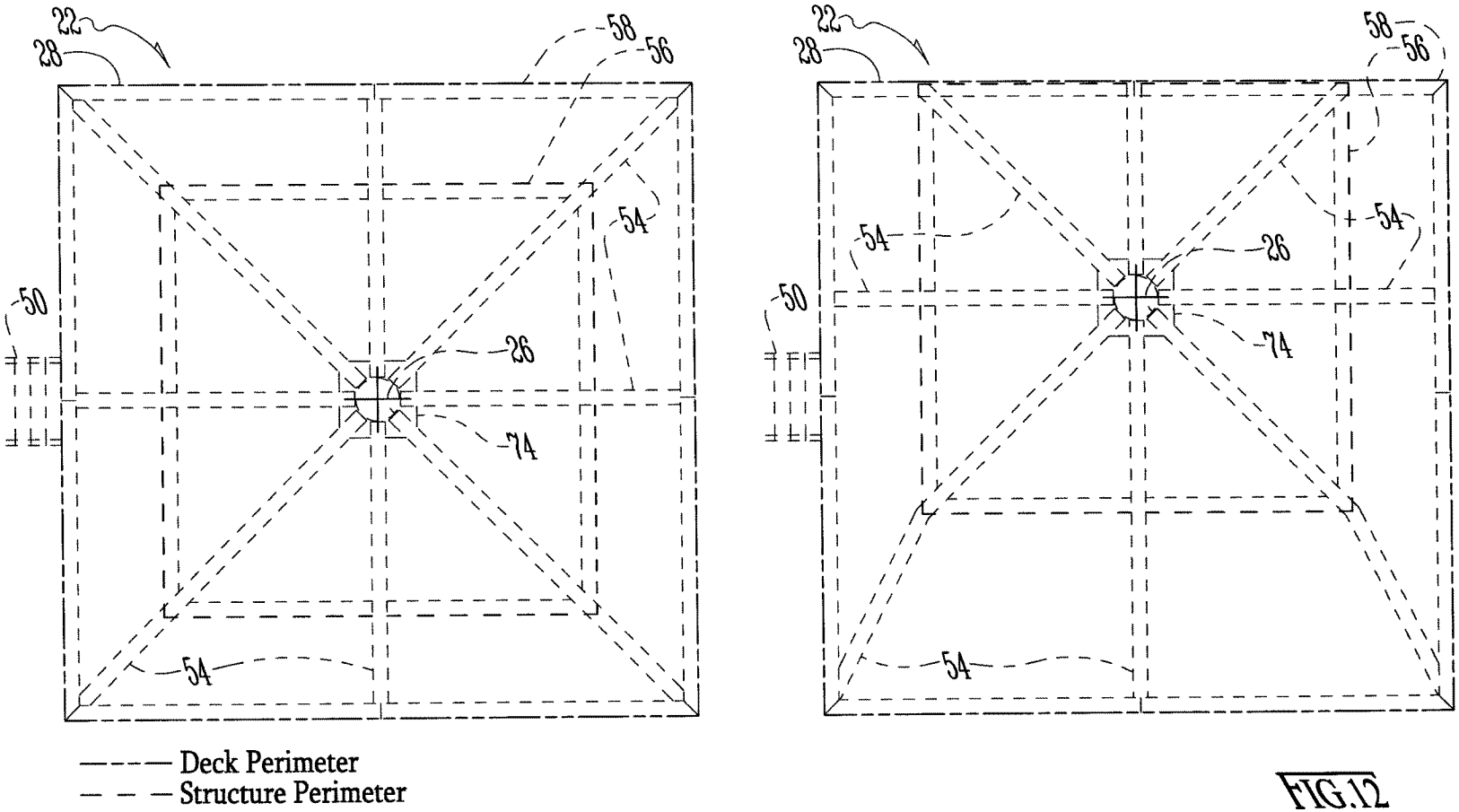
FIG. 12 is a top plan view of FIG. 3 in part, showing the layout of the structural (steel) monopole as well as the structural (steel) struts of FIG. 3 in the left half of the view, and, an alternate layout in right half of the view.

As a final matter, FIG. 12 can be compared to FIG. 3 in order to show that the layout of the structural (steel) monopole 26 as well as the structural (steel) struts 32 of FIG. 3 shown in the left half of the view, can be varied in an indefinite number of designs, including without limitation what is shown in the right half of the view.

Figure 13:
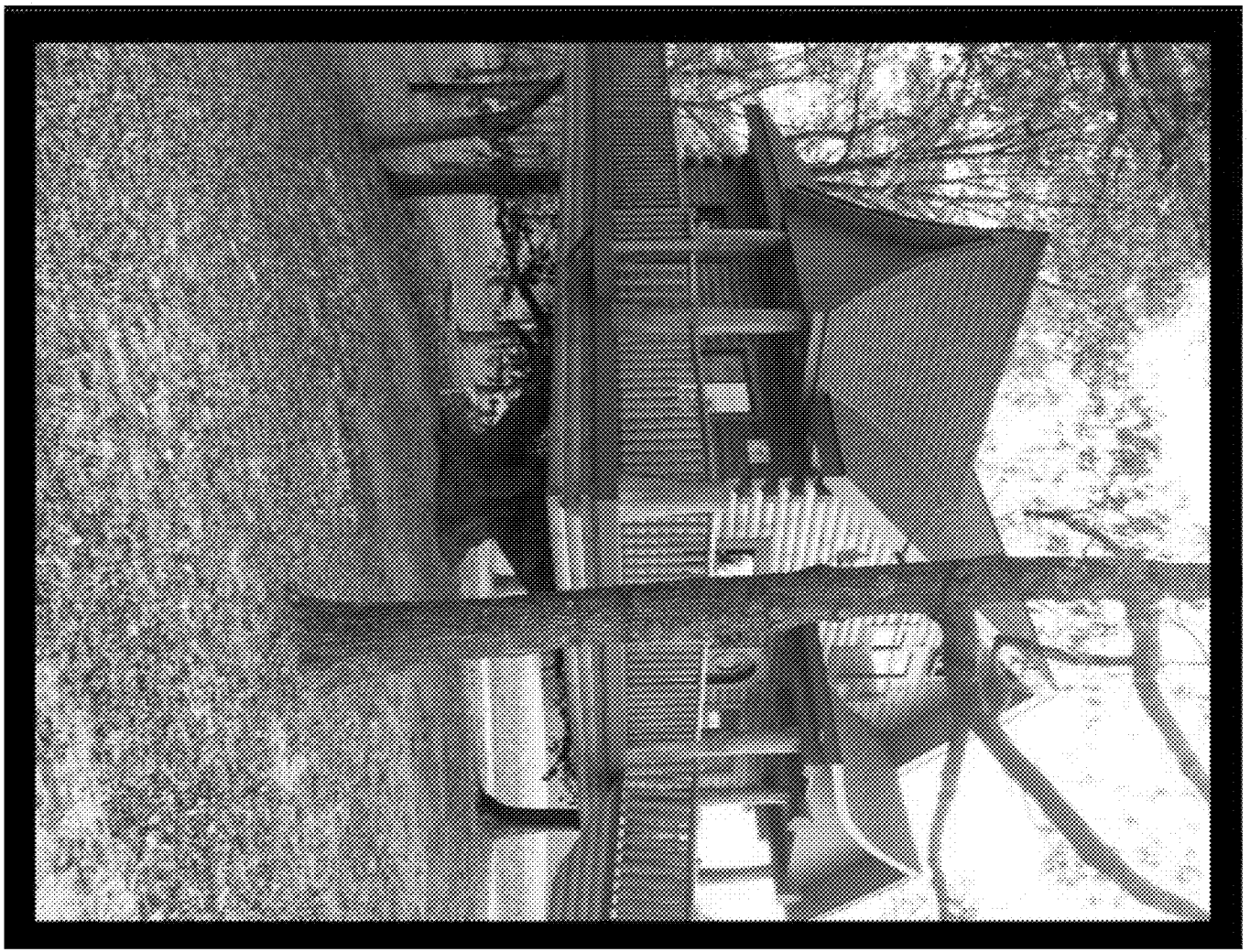
FIG. 13 is a pictorial view of an elevated tree house on a monopole support structure decorated as a simulated tree trunk tree in accordance with the invention.
Figure 14:
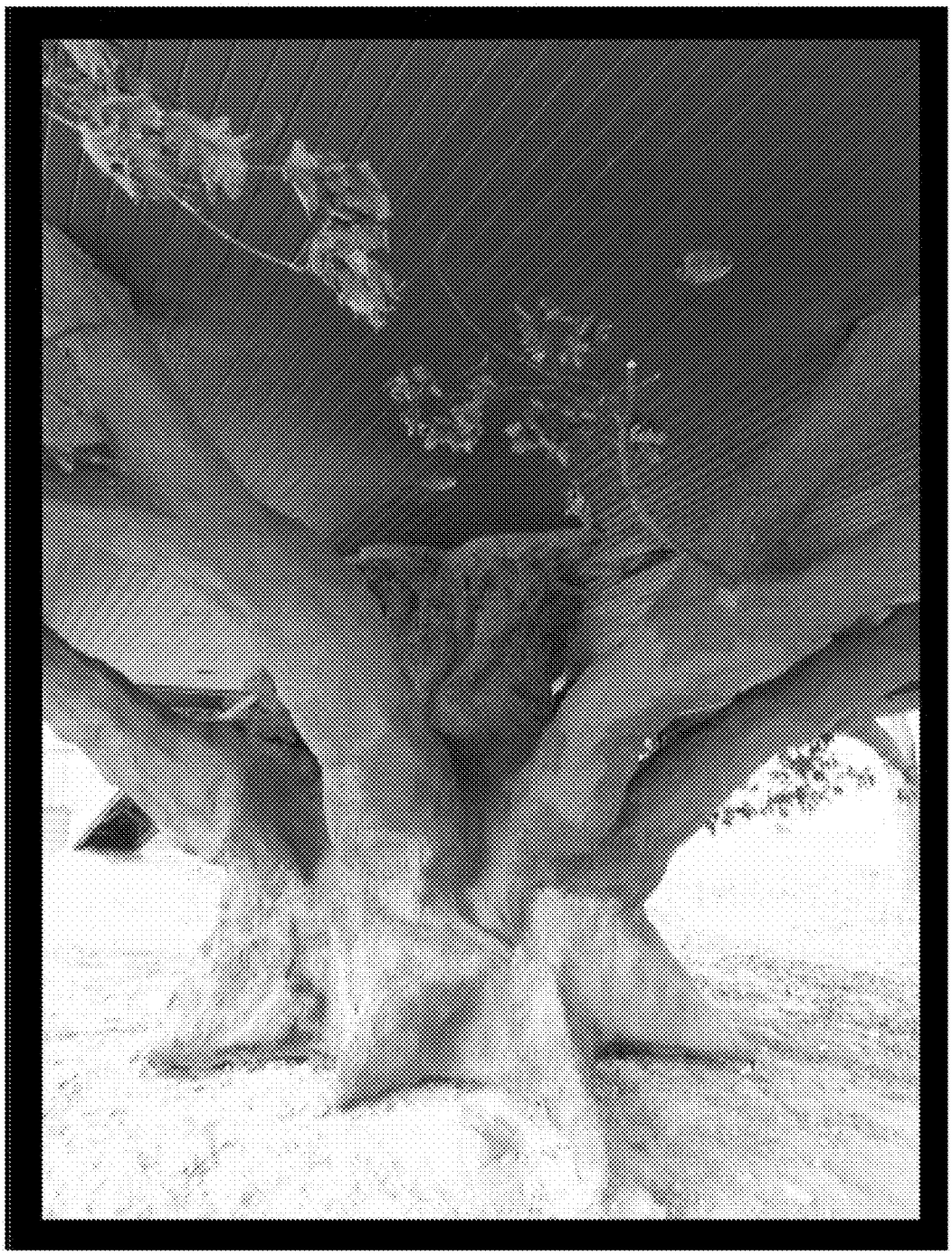
FIG. 14 is an enlarged scale detail view of the monopole support structure decorated as a simulated tree trunk tree generally in accordance with the invention, but more particularly in accordance with FIG. 13.

FIGS. 13 and 14 comprise a pair of figures "executed in color." More simply, these are photographs of a representative elevated tree house 20 on a monopole support structure 22 decorated as a simulated tree trunk tree 24 in accordance with the invention. FIG. 14 shows better this representative monopole support structure 22 decorated as a simulated tree trunk tree 24 generally in accordance with the invention, but as taken from below the FIG. 13 platform 28/deck 60 of the tree house 20.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method of making a simulated tree trunk for an elevated tree house with water and sewer utilities running through the simulated tree trunk; comprising the steps of:

siting a location of ground;

excavating a hole in the ground;

sinking a monopole having a hollow center into the excavated hole;

anchoring the monopole in the excavated hole;

attaching to the monopole a platform which will serve to carry the elevated house, said platform having a bottom;

adding steel support braces that extend from the monopole to the bottom of the platform to add strength and further decoration;

hiding the water and sewer utilities through the center of the monopole; and decorating the monopole with a faux finish to create an appearance of a simulated tree trunk and the support braces with a faux finish to create an appearance of simulated tree branches.

2. The method of claim 1, further comprising:

making the house accessible by ramp, stairs or ladder.

3. The method of claim 1, further comprising:

siting the elevated house on a slope having high ground sloping to dropping ground with the high ground being in front of the house and the dropping ground being behind the house; and running a ramp from the high ground in order to incline the platform at a shallower angle and in order to cantilever the back of the house over the dropping ground for a better view.

4. The method of claim 1, further comprising:

constructing rebar into wavy stringers that extend along the monopole from the ground to the platform and then also along the support braces lengthwise from the monopole to the platform;

constructing rebar into rings along the monopole and/or support braces to provide contour;

wrapping mesh screen around rebar;

coating the mesh screen with a layer of wet coating material which will, when dry, harden; and decorating the coating material with the faux finish comprising a texture simulative of tree bark.

5. The method of claim 4, wherein:

the step of decorating the coating material with the faux finish comprising a texture simulative of tree bark; further comprises:

imprinting the wet coating material, before hardening, with texture simulative of tree bark.

6. The method of claim 4, further comprising:

making raised knots or recessed holes into the coating material.

7. The method of claim 4, further comprising:

dressing the branches with real or fake twigs and leaves.

8. The method of claim 7, further comprising:

changing the real of fake twigs and leaves at a plural times during the year to reflect the change of seasons.

9. The method of claim 1, further comprising:

siting the monopole and platform among pre-existing live trees;

oversizing the platform larger than the house to provide a deck therefor; and forming the deck with openings to accommodate pre-existing trees and allow the pre-existing trees to grow through the deck to add to decoration.

10. A method of constructing an elevated tree house on a columnar support structure decorated as a simulated tree trunk; comprising the steps of;

siting a location of ground;

sinking a vertical columnar support structure into an excavated hole in the ground;

anchoring the vertical columnar support structure in the excavated hole;

connecting buried water and sewer utilities to conduits extending inside of or alongside the columnar support structure;

attaching thereto a platform that is supported elevated off the ground by the columnar structure;

bracing the platform with a plurality of diagonal support braces that have base ends attached to the columnar support structure and have upper ends bracing the platform at spaced away positions from the columnar support structure wherein support braces flare up and out from the base ends attached to the columnar support structure, to, the upper ends bracing the platform;

erecting a house on top of the platform and plumbing the water and sewer conduits to water and sewer appliances; and decorating the columnar support structure with a faux finish to create an appearance of a simulated tree trunk and the support braces with a faux finish to create an appearance of simulated tree branches.

11. The method of claim 10, wherein:

the step of bracing the platform with a plurality of diagonal support braces that have base ends attached to the columnar support structure and have upper ends bracing the platform at spaced away positions from the columnar support structure wherein support braces flare up and out from the base ends attached to the columnar support structure, to, the upper ends bracing the platform;

further comprises:

bracing the platform with a plurality of diagonal support braces that have base ends attached to the columnar support structure and have upper ends bracing the platform at spaced away positions from the columnar support structure wherein support braces flare up and out from the base ends attached to the columnar support structure, to, the upper ends bracing the platform.

12. The method of claim 10, further comprising:

covering the columnar support structure and the diagonal braces in an artistically wavy or loopy network of strand material;

covering the network of strand material with a network of mesh material;

covering the network of mesh material with a wet coating material which will, when dry, harden; and decorating the coating material with the faux finish comprising a texture simulative of tree bark.

13. The method of claim 12, wherein:

the step of decorating the coating material with the faux finish comprising a texture simulative of tree bark; further comprises:

imprinting the wet coating material, before hardening, with texture simulative of tree bark.

14. The method of claim 12, further comprising:

adding an additional artistically wavy or loopy network of strand material between at least one of the diagonal braces and the bottom of the platform at a position spaced away from the columnar support structure in the appearance of a non-load bearing but simulative secondary branch;

covering the additional network of strand material that appears as a secondary branch with a network of mesh material;

covering the network of mesh material that covers the additional network of strand material that appears as a secondary branch with a coat of wet coating material which will, when dry, harden; and decorating the coat of wet coating material with the faux finish comprising a texture simulative of tree bark.

15. The method of claim 12, further comprising:

denoting a portion of the columnar support structure from the ground to a relatively higher elevation to be a base portion therefor:

adding a further artistically wavy or loopy network of strand material around the base of the columnar support structure to appear as a broad root flare of a stout tree trunk;

covering the further network of strand material that appears as a root flare with a further network of mesh material;

covering the further network of mesh material that covers the further network of strand material that appears as a root flare with a layer wet coating material which will, when dry, harden; and decorating the layer of wet coating material with the faux finish comprising a texture simulative of tree bark texture at and around the root flare;

whereby the simulative root flare serves as a faux contrivance to hide excavation scars for sinking and anchoring the columnar support structure.

16. The method of claim 15, further comprising:

connecting the platform to the columnar support structure at a junction by mechanical connections;

adding an artistically wavy or loopy network of strand material around the junction of the columnar support structure with the platform in the appearance of a broad crown flare of a stout tree trunk;

covering the network of strand material that appears as a crown flare with a network of mesh material;

covering the network of mesh material that covers the network of strand material that appears as a crown flare with a wet coating material which will, when dry, harden; and decorating the foregoing coating material with the faux finish comprising a texture simulative of tree bark texture;

whereby the simulative crown flare serves as a faux contrivance to hide the mechanical connections between the columnar support structure and the platform.

17. The method of claim 10, further comprising:

covering selected portions of the diagonal braces in an artistically wavy or loopy network of strand material, leaving other portions bare;

covering the selected portions of the network of strand material with a network of mesh material, which still leaves the other portions bare;

covering the selected portions of the network of mesh material with a wet coating material which will, when dry, harden, and which will still leave the other portions bare; and decorating the coating material with the faux finish comprising a texture simulative of tree bark;

whereby the bare portions of braces, which braces are otherwise covered in simulated tree branch decoration, simulate like vegetative growth swallowed the structural brace.

18. The method of claim 17, further comprising:

covering chosen portions of the columnar support structure in an artistically wavy or loopy network of strand material, leaving uncovered portions bare;

covering the chosen portions of the network of strand material with a network of mesh material, which still leaves the uncovered portions bare;

covering the chosen portions of the network of mesh material with a wet coating material which will, when dry, harden, and which will still leave the uncovered portions bare; and decorating the coating material with the faux finish comprising a texture simulative of tree bark;

whereby the bare portions of columnar support structure, which columnar support structure is otherwise covered in simulated tree branch decoration, simulate like vegetative growth swallowed the columnar support structure.

19. The method of claim 10, further comprising:

making raised knots or recessed holes into the coating material.

20. The method of claim 10, further comprising:

dressing the branches with real or fake twigs and leaves.

* * * * *